US006111346A

United States Patent [19]

Ito et al.

[11] Patent Number: 6,111,346

[45] Date of Patent: Aug. 29, 2000

[54] COLOR CATHODE RAY TUBE HAVING SHADOW MASK STRUCTURE WITH CURL REDUCED IN SKIRT PORTION

[75] Inventors: Hiroshi Ito; Nobuhiko Hosotani; Masahiro Ito; Koji Hagiwara, all of Mobara, Japan

[73] Assignees: Hitachi, Ltd., Tokyo; Hitachi Electronic Device Co., Ltd., Chiba-Ken, both of Japan

[21] Appl. No.: 09/035,896

[22] Filed: Mar. 6, 1998

[30] Foreign Application Priority Data

Mar. 11, 1997 [JP] Japan ..... 9-056286

[51] Int. Cl.[7] ..... H61J 29/80

[52] U.S. Cl. ..... 313/402; 313/404; 313/406

[58] Field of Search ..... 313/402, 404, 313/407, 408, 406

[56] References Cited

U.S. PATENT DOCUMENTS

| | | | |
|---|---|---|---|
| 3,351,996 | 11/1967 | Fiore . | |
| 3,585,431 | 6/1971 | Long . | |
| 3,855,493 | 12/1974 | Snook et al. | 313/402 |
| 3,862,448 | 1/1975 | Ishizuka et al. | 313/402 |
| 3,878,427 | 4/1975 | Godfrey | 313/403 |
| 3,912,963 | 10/1975 | Sedivy | 313/403 |
| 4,122,368 | 10/1978 | Masterton | 313/403 |
| 4,146,816 | 3/1979 | Morrell | 313/407 |
| 4,327,307 | 4/1982 | Penird et al. | 313/407 |
| 4,437,036 | 3/1984 | Ragland, Jr. | 313/402 |
| 4,949,009 | 8/1990 | Iwamoto | 313/407 |
| 5,576,595 | 11/1996 | Inoue | 313/402 |

FOREIGN PATENT DOCUMENTS 3-76352 7/1991 Japan .

*Primary Examiner*—Nimeshkumar D. Patel
*Assistant Examiner*—Michael J. Smith
*Attorney, Agent, or Firm*—Antonelli, Terry, Stout & Kraus, LLP

[57] ABSTRACT

A color cathode ray tube includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding the skirt portion thereto, within a panel portion of the color cathode ray tube. The skirt portion is provided with a plurality of slits extending in a direction of a height of the skirt portion and a plurality of embossments extending in the direction of the height of the skirt portion, and the slits and the embossments are juxtaposed around a circumference of the skirt portion.

9 Claims, 9 Drawing Sheets

COLOR CATHODE RAY TUBE HAVING SHADOW MASK STRUCTURE WITH CURL REDUCED IN SKIRT PORTION

BACKGROUND OF THE INVENTION

The present invention relates to a shadow mask type color cathode ray tube, and more particularly to a shadow mask type color cathode ray tube provided with a shadow mask capable of being installed into the color cathode ray tube without causing curvature distortions or reduction in strength of the shadow mask by reducing curls occurring in the skirt portion thereof in press-forming the shadow mask.

Generally in assembling a shadow mask type color cathode ray tube, a skirt portion of the shadow mask formed by press-forming is fitted within a support frame, the shadow mask is affixed to the support frame by spot welding, and then the support frame is suspended within a panel portion of the color cathode ray tube such that the shadow mask is positioned adjacent to, but spaced from a phosphor film formed on the inner surface of a faceplate of the panel portion.

FIGS. 4A to 4C are respectively structural views showing an example of the shadow mask used for a conventional color cathode ray tube. FIG. 4A is a front view of the shadow mask, FIG. 4B is an enlarged fragmentary side view of an area in the vicinity of welds in the skirt portion thereof, and FIG. 4C is a sectional view of a region extending from an imperforate portion to the skirt portion. In FIGS. 4A to 4C, reference numeral 41 designates a shadow mask; 42 is an apertured portion; 43 is an imperforate portion; and 44 is a skirt portion, and x marks indicate welds.

The shadow mask 41 has a curved apertured portion 42 having a multiplicity of electron-transmissive apertures, a curved imperforate portion 43 surrounding and integral with the apertured portion 42 and a skirt portion 44 bent back from a periphery of the curved imperforate portion 43, and is usually integrally formed by press-forming a multi-apertured thin sheet-like metal blank.

In this case, the multi-apertured thin sheet-like metal blank is very thin and relatively weak in strength. Therefore, the press-formed shadow mask 41 is not always good in forming characteristics. Especially, the skirt portion 44 of the shadow mask 41 curls outwardly by a distance S from a straight line passing through a bend line between the imperforate portion 43 and the skirt portion 44 and parallel to the longitudinal axis of the cathode ray tube, in a region centering about the center of each side of the generally rectangular shadow mask 41, as shown in FIG. 4C.

The skirt portion 44 of the press-formed shadow mask 41 is fitted within or outside a support frame (not shown), and is welded and affixed to the support frame at a few points. As indicated in FIG. 4B by x marks, welds of the skirt portion 44 and the support frame are located two in the vicinity of the center of each of the long and short sides of the shadow mask 41, and one at each of the four corners thereof, for example.

When the conventional shadow mask 41 is press-formed, occurrence of the curl S in the skirt portion 44 is unavoidable, and if the curl S is excessively large, it is an obstacle to fitting the skirt portion 44 into the support frame and welding the fitted portion thereof to the support frame, resulting in reduction of workability.

Further, when the skirt portion 44 of the conventional shadow mask 41 having the large curl S is forcibly fitted in the support frame, the stress applied to the skirt portion 44 is transmitted to the imperforate portion 43 and the apertured portion 42, and distorts the curved contour of the apertured portion 42 of the shadow mask 41, and as a result, the color selection property of the shadow mask 41 is degraded, and the strength of the shadow mask 41 is reduced.

SUMMARY OF THE INVENTION

The present invention solves these problems as noted above, and an object of the present invention is to provide a shadow mask type color cathode ray tube provided with a shadow mask having the workability improved in being affixed to the support frame and its curvature distortions prevented, by reducing the amount of curls in the skirt portion of the press-formed shadow mask.

For achieving the aforesaid object, a color cathode ray tube according to an embodiment of the present invention includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding the skirt portion thereto, within a panel portion of the color cathode ray tube; wherein the skirt portion is provided with a plurality of slits extending in a direction of a height of the skirt portion and a plurality of embossments extending in the direction of the height of the skirt portion, and the slits and the embossments are juxtaposed around a circumference of the skirt portion.

BRIEF DESCRIPTION OF THE DRAWINGS

The drawings form an integral part of the specification and are to be read in conjunction therewith, in which like reference numerals designate similar components throughout the figures, and in which.

DETAILED DESCRIPTION OF THE PREFERRED EMBODIMENTS

A color cathode ray tube according to an embodiment of the present invention includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding the skirt portion thereto, within a panel portion of the color cathode ray tube; wherein the skirt portion is provided with a plurality of slits extending in a direction of a height of the skirt portion from a rear end of the skirt portion on an opposite side from the panel portions, and a plurality of embossments extending in the direction of the height of the skirt portion from the rear end of the skirt portion, and the slits and the embossments are juxtaposed around a circumference of the skirt portion.

In a color cathode ray tube according to a more specific embodiment of the present invention, the plurality of slits extend a distance of 30 to 70% of the height of the skirt portion from a rear end thereof and the plurality of embossments extend an entire length of the height of the skirt portion.

In an embodiment of the present invention, a pair of the plurality of slits are disposed one on each side of a midpoint of each of long and short sides of the skirt portion, and remainders of the plurality of slits and the plurality of embossments are arranged alternately with each other.

In another embodiment of the present invention, a pair of the plurality of embossments are disposed one on each side of a midpoint of each of long and short sides of the skirt portion, and remainders of the plurality of slits and the plurality of embossments are arranged alternately with each other.

According to these embodiments, a plurality of slits and a plurality of embossments can be formed to be juxtaposed over a wide region of each of long and short sides of the skirt portion in the same operation used for press-forming the skirt portion. This reduces significantly the tendency of the press-formed skirt portion to return to its initial form, reduces the curl S produced in the skirt portion, and limits the curl S within a relatively small range over the entire periphery of the skirt portion. Therefore, the stress caused to the skirt portion by fitting the skirt portion in the support frame is not transmitted to the imperforate portion or the apertured portion so that the curved contour of the apertured portion of the shadow mask is not distorted, and consequently the color selection property of the shadow mask is not deteriorated, or the strength of the shadow mask is not reduced.

The embodiments of the present invention will be described hereinafter with reference to the drawings.

Figure 1:
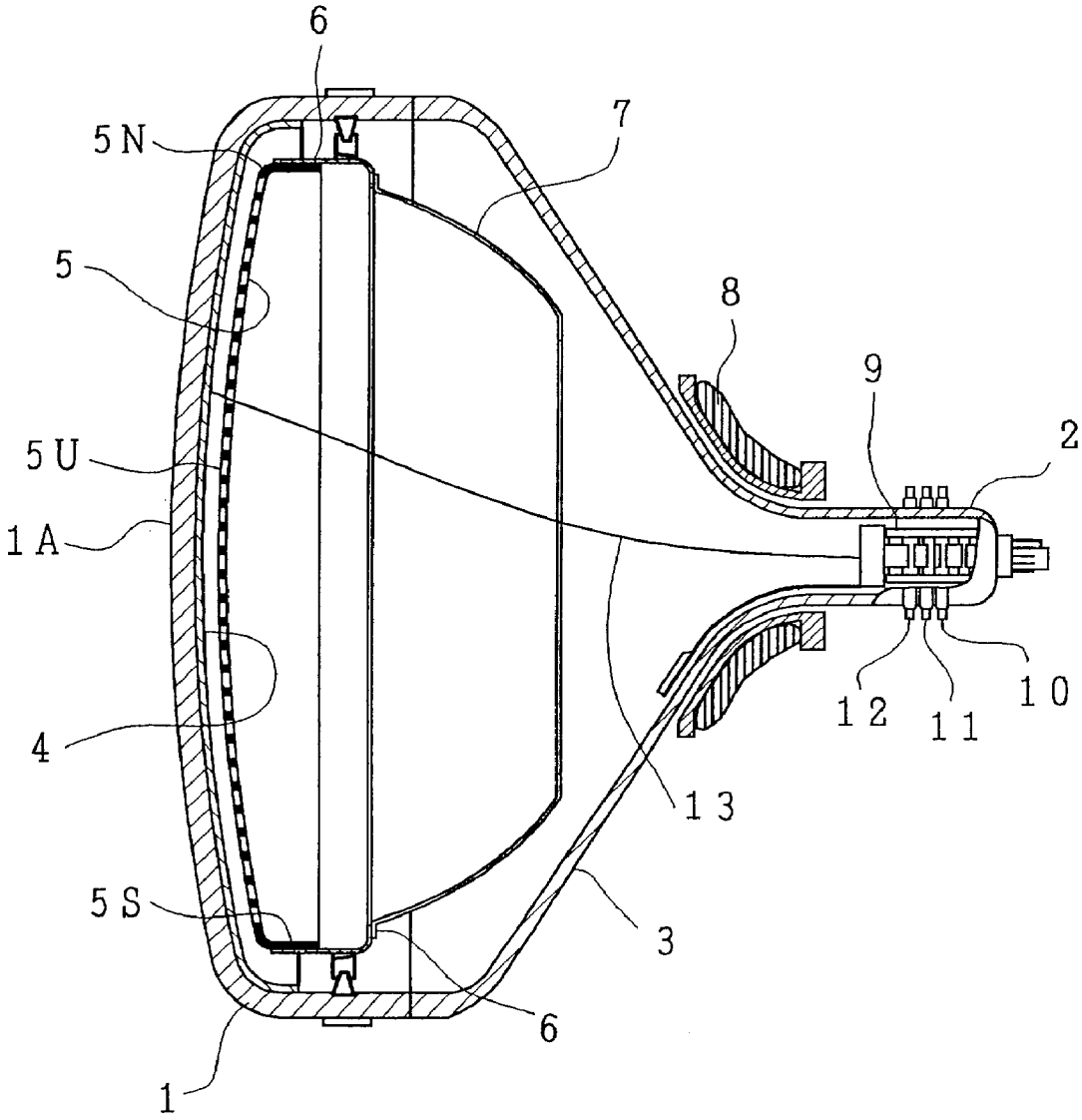
FIG. 1 is a sectional view showing a schematic structure of an embodiment of a shadow mask type color cathode ray tube according to the present invention.

FIG. 1 is a sectional view showing a schematic structure of an embodiment of a shadow mask type color cathode ray tube according to the present invention.

In FIG. 1, reference numeral 1 designates a panel portion; 1A is a faceplate; 2 is a neck portion; 3 is a funnel portion; 4 is a phosphor film; 5 is a shadow mask; 5U is an apertured portion; 5N is an imperforate portion; 5S is a skirt portion; 6 is a support frame; 7 is an internal magnetic shield; 8 is a deflection yoke; 9 is an electron gun; 10 is a color purity adjustment magnet; 11 is a four-pole magnet for static beam convergence adjustment; 12 is a six-pole magnet for static beam convergence adjustment; and 13 is an electron beam.

An evacuated envelope (glass bulb) constituting the color cathode ray tube comprises the panel portion 1 having the generally rectangular faceplate 1A, the elongated cylindrical neck portion 2 housing the electron gun 8 therein, and the funnel portion 3 joining the panel portion 1 and the neck portion 2. In the panel portion 1, the phosphor film 4 is formed on the internal surface of the faceplate 1A, and the support frame 6 is affixed to the internal surface of the sidewall of the panel portion. In incorporating the shadow mask 5, the skirt portion 5S is welded to the support frame 6, and the apertured portion 5U and the imperforate portion 5N are positioned adjacent to, but spaced from the phosphor film 4. In the funnel portion 3, the internal magnetic shield 7 is positioned on the side thereof facing the panel portion 1, and the deflection yoke 8 is mounted on the side thereof facing the neck portion 2 around the funnel portion. Externally of the neck portion 2 are juxtaposed the color purity adjustment magnet 10, the four-pole magnet 11 for static beam convergence adjustment, and the six-pole magnet 12 for static beam convergence adjustment. Three electron beams 13 (only one shown in FIG. 1) projected from the electron gun 9 impinge, after having been deflected in a desired direction by the deflection yoke 8, upon the phosphor film 4 through a multiplicity of electron-transmissive apertures provided in the apertured portion 5U of the shadow mask 5 to reproduce the desired image on the phosphor film 4.

In this case, the operation of the color cathode ray tube according to the present embodiment, that is, the image display operation is the same as that in the conventional color cathode ray tube of this kind, and the image display operation has been well known. Therefore, the description of the image display operation in the color cathode ray tube according to the present embodiment will be omitted.

Figure 2C:
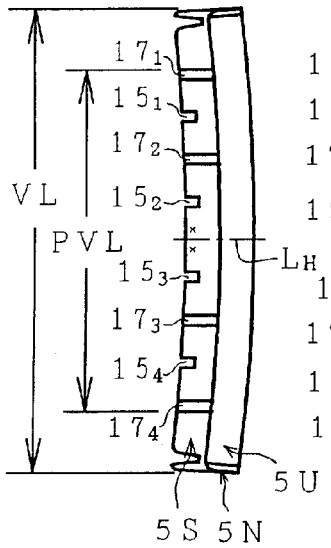
FIGS. 2A to 2D are respectively structural views showing a first embodiment of a shadow mask used for the color cathode ray tube shown in FIG. 1, FIG. 2A being a top view thereof, FIG. 2B being a side view of a long side thereof, FIG. 2C being a side view of a short side thereof, and FIG. 2D being an enlarged fragmentary perspective view of the skirt portion thereof.
Figure 2A:
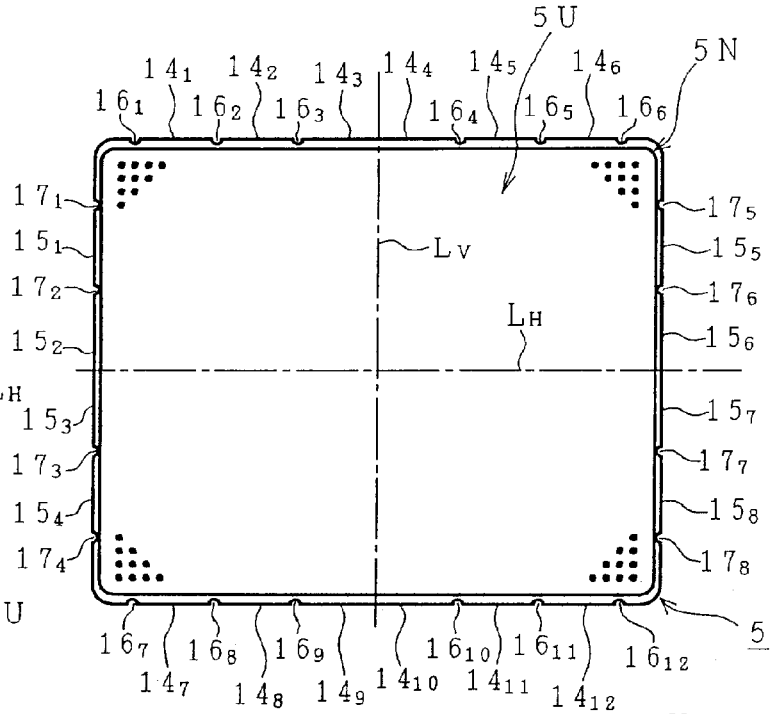
Figure 2B:
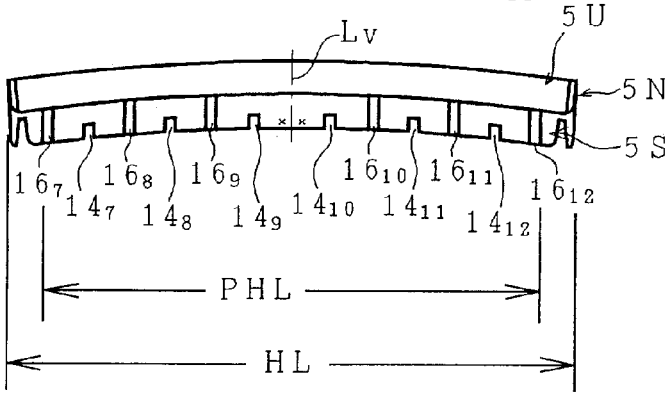
Figure 2D:
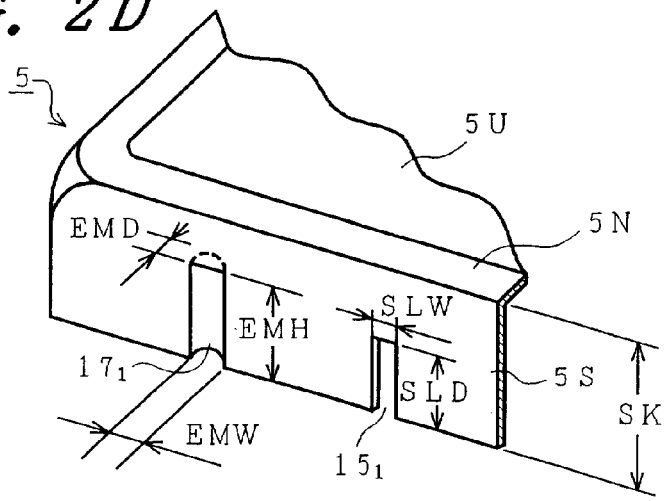

FIGS. 2A to 2D are respectively structural views showing a first embodiment of a shadow mask 5 used for the color cathode ray tube shown in FIG. 1, FIG. 2A being a top view thereof, FIG. 2B being a side view of a long side thereof, FIG. 2C being a side view of a short side thereof, FIG. 2D being an enlarged fragmentary perspective view of the skirt portion thereof.

The material thickness of the shadow mask is normally in the range of 0.1 to 0.2 mm. In the present embodiment, a Fe—Ni Invar alloy material having 0.13 mm of thickness was used.

For the support frame 6, normally, low carbon steel or stainless steel having 1 to 2 mm of thickness is used. In the present embodiment, low carbon steel having 1.2 mm of thickness was used.

In FIGS. 2A to 2D, reference numerals $\mathbf{14}_1$, $\mathbf{14}_2$, $\mathbf{14}_3$, $\mathbf{14}_4$, $\mathbf{14}_5$, and $\mathbf{14}_6$ designate slits provided in one of the long sides of the skirt portion 5S; $\mathbf{14}_7$, $\mathbf{14}_8$, $\mathbf{14}_9$, $\mathbf{14}_{10}$, $\mathbf{14}_{11}$, and $\mathbf{14}_{12}$, designate slits provided in the other of the long sides of the skirt portion 5S; reference numerals $\mathbf{15}_1$, $\mathbf{15}_2$, $\mathbf{15}_3$, and $\mathbf{15}_4$ designate slits provided in one of the short sides of the skirt portion 5S; reference numerals $\mathbf{15}_5$, $\mathbf{15}_6$, $\mathbf{15}_7$, and $\mathbf{15}_8$ designate slits provided in the other of the short sides of the skirt portion 5S; reference numerals $\mathbf{16}_1$, $\mathbf{16}_2$, $\mathbf{16}_3$, $\mathbf{16}_4$, $\mathbf{16}_5$, and $\mathbf{16}_6$ designate embossments provided in the one of the long sides of the skirt portion 5S; reference numerals $\mathbf{16}_7$, $\mathbf{16}_8$, $\mathbf{16}_9$, $\mathbf{16}_{10}$, $\mathbf{16}_{11}$, and $\mathbf{16}_{12}$ designate embossments provided in the other of the long sides of the skirt portion 5S; reference numerals $\mathbf{17}_1$, $\mathbf{17}_2$, $\mathbf{17}_3$, and $\mathbf{17}_4$ designate embossments provided in the one of the short sides of the skirt portion 5S; and reference numerals $\mathbf{17}_5$, $\mathbf{17}_6$, $\mathbf{17}_7$, and $\mathbf{17}_8$ designate embossments provided in the other of the short sides of the skirt portion 5S. The same constituent elements as those shown in FIG. 1 are indicated by the same reference numerals. X marks designate welds; $L_V$ a straight line passing through the centers of the long sides, and $L_H$ a straight line passing through the centers of the short sides.

The shadow mask 5 comprises an apertured portion 5U in the form of a curved contour provided with a multiplicity of electron-transmissive apertures, an imperforate portion 5N in the form of a curved contour in the periphery and integral with the apertured portion 5U, and a skirt portion 5S bent back from a periphery of the imperforate portion 5N. The slits $\mathbf{14}_1$ to $\mathbf{14}_{12}$ and $\mathbf{15}_1$ to $\mathbf{15}_8$ are of the shape of a generally inverted U slit having a depth of about half of a height of the skirt portion 5S, measured from the rear or lower end of the skirt portion 5S, and the embossments $\mathbf{16}_1$ to $\mathbf{16}_{12}$ and $\mathbf{17}_1$ to $\mathbf{17}_8$ are arcuate in cross section, protrude inwardly from the skirt portion 5S and extend along the entire height of the skirt portion 5S.

The skirt portion 5S in each of the long sides of the shadow mask 5 are provided with welds near and on opposite sides of a straight line $L_V$ passing through the centers of the long sides as indicated by x marks in FIG. 2B. In the skirt portion 5S in the one of the long sides, three slits $\mathbf{14}_1$ to $\mathbf{14}_3$ and three embossments $\mathbf{16}_1$ to $\mathbf{16}_3$ are provided on one side of the center line $L_V$, and three slits $\mathbf{14}_4$ to $\mathbf{14}_6$ and three embossments $\mathbf{16}_4$ to $\mathbf{16}_6$ are provided on the other side of the center line $L_V$. In the skirt portion 5S in the other of the long sides, three slits $\mathbf{14}_7$ to $\mathbf{14}_9$ and three embossments $\mathbf{16}_7$ to $\mathbf{16}_9$ are provided on one side of the center line $L_V$, and three slits $\mathbf{14}_{10}$ to $\mathbf{14}_{12}$ and three embossments $\mathbf{16}_{10}$ to $\mathbf{16}_{12}$ are provided on the other side of the center line $L_V$.

Further, the skirt portion 5S in each of the short sides of the shadow mask 5 are provided with welds near and on opposite sides of a straight line $L_H$ passing through the centers of the short sides as indicated by x marks in FIG. 2C. In the skirt portion 5S in the one of the short sides, two slits $\mathbf{15}_1$ and $\mathbf{15}_2$ and two embossments $\mathbf{17}_1$ and $\mathbf{17}_2$ are provided on one side of the center line $L_H$ and two slits $\mathbf{15}_3$ and $\mathbf{15}_4$ and two embossments $\mathbf{17}_3$ and $\mathbf{17}_4$ are provided on the other side of the center line $L_H$. In the skirt portion in the other of the short sides, two slits $\mathbf{15}_5$ and $\mathbf{15}_6$ and two embossments $\mathbf{17}_5$ and $\mathbf{17}_6$ are provided on one side of the center $L_H$ and two slits $\mathbf{15}_7$ and $\mathbf{15}_8$ and two embossments $\mathbf{17}_7$ and $\mathbf{17}_8$ are provided on the other side of the center line $L_H$.

For example, in the case where the outside diagonal dimension of the panel portion of the color cathode ray tube is 19 inches, and the dimensions of the apertured portion 5U of the shadow mask 5 are about 365 mm in width and about 275 mm in height, the dimensions and positions of the slits $\mathbf{14}_1$ to $\mathbf{14}_{12}$ and $\mathbf{15}_1$ to $\mathbf{15}_6$ and the embossments $\mathbf{16}_1$ to $\mathbf{16}_{12}$ and $\mathbf{17}_1$ to $\mathbf{17}_6$ are as follows:

In FIG. 2D, for the dimensions of the slits $\mathbf{14}_1$ to $\mathbf{14}_{12}$ and $\mathbf{15}_1$ to $\mathbf{15}_8$, the slit width SLW is about 3 mm and the slit depth SLD is 6.5 mm, and for the dimensions of the embossments $\mathbf{16}_1$ to $\mathbf{16}_{12}$ and $\mathbf{17}_1$ to $\mathbf{17}_6$, the width EM is about 6 mm, the depth EMD is 0.8 mm, and the height EMH is the same as the skirt height SK as shown in FIGS. 2A and 2B (however, in FIG. 2D, for generalization, the height EMH is depicted to be smaller than the skirt height SK).

In the skirt portion 5S in one of the long sides of the shadow mask, two slits $\mathbf{14}_3$ and $\mathbf{14}_4$ are adjacent to and spaced about 25 mm from the center line $L_V$, respectively and each of distances between two adjacent slits, $\mathbf{14}_1$ and $\mathbf{14}_2$; $\mathbf{14}_2$ and $\mathbf{14}_3$; $\mathbf{14}_4$ and $\mathbf{14}_5$; and $\mathbf{14}_5$ and $\mathbf{14}_6$ is about 50 mm. In the skirt portion 5S in the other of the long sides of the shadow mask two slits $\mathbf{14}_9$ and $\mathbf{14}_{10}$ are adjacent to and spaced about 25 mm from the center line $L_V$, respectively and each of distances between two adjacent slits, $\mathbf{14}_7$ and $\mathbf{14}_8$; $\mathbf{14}_8$ and $\mathbf{14}_9$; $\mathbf{14}_{10}$ and $\mathbf{14}_{11}$; and $\mathbf{14}_{11}$ and $\mathbf{14}_{12}$ is about 50 mm. In the skirt portion 5S in one of the short sides of the shadow mask, two slits $\mathbf{15}_2$ and $\mathbf{15}_3$ are adjacent to and spaced about 25 mm from the center line $L_H$, respectively and each of distances between two adjacent slits, $\mathbf{15}_1$ and $\mathbf{15}_2$; and $\mathbf{15}_3$ and $\mathbf{15}_4$ is about 50 mm. In the skirt portion 5S in the other of the short sides of the shadow mask two slits $\mathbf{15}_6$ and $\mathbf{15}_7$ are adjacent to and spaced about 25 mm from the center line $L_H$, respectively and each of distances between two adjacent slits, $\mathbf{15}_5$ and $\mathbf{15}_6$; and $\mathbf{15}_7$ and $\mathbf{15}_8$ is about 50 mm.

In the skirt portion 5S in one of the long sides of the shadow mask, two embossments $\mathbf{16}_3$ and $\mathbf{16}_4$ are adjacent to and spaced about 50 mm from the center line $L_V$, respectively and each of distances between two adjacent slits, $\mathbf{16}_1$ and $\mathbf{16}_2$; $\mathbf{16}_2$ and $\mathbf{16}_3$; $\mathbf{16}_4$ and $\mathbf{16}_5$; and $\mathbf{16}_5$ and $\mathbf{16}_6$ is about 50 mm. In the skirt portion 5S in the other of the long sides of the shadow mask two embossments $\mathbf{16}_9$ and $\mathbf{16}_{10}$ are adjacent to and spaced about 50 mm from the center line $L_V$, respectively and each of distances between two adjacent slits, $\mathbf{16}_7$ and $\mathbf{16}_8$; $\mathbf{16}_8$ and $\mathbf{16}_9$; $\mathbf{16}_{10}$ and $\mathbf{16}_{11}$; and $\mathbf{16}_{11}$ and $\mathbf{16}_{12}$ is about 50 mm. In the skirt portion 5S in one of the short sides of the shadow mask, two embossments $\mathbf{17}_2$ and $\mathbf{17}_3$ are adjacent to and spaced about 50 mm from the center line $L_H$, respectively and each of distances between two adjacent embossments, $\mathbf{17}_1$ and $\mathbf{17}_2$; and $\mathbf{17}_3$ and $\mathbf{17}_4$ is about 50 mm. In the skirt portion 5S in the other of the short sides of the shadow mask two embossments $\mathbf{17}_6$ and $\mathbf{17}_7$ are adjacent to and spaced about 50 mm from the center line $L_H$, respectively and each of distances between two embossments, $\mathbf{17}_5$ and $\mathbf{17}_6$; and $\mathbf{17}_7$ and $\mathbf{17}_8$ is about 50 mm.

As described above, the slits $\mathbf{14}_1$ to $\mathbf{14}_{12}$ and the embossments $\mathbf{16}_1$ to $\mathbf{16}_2$ are arranged such that they are alternately positioned on the opposite sides of the center line $L_V$ in the skirt portion 5S in the long sides of the shadow mask, and similarly, the slits $\mathbf{15}_1$ to $\mathbf{15}_8$ and the embossments $\mathbf{17}_1$ to $\mathbf{17}_8$ are arranged such that they are alternately positioned on the opposite sides of the center line $L_H$ in the skirt portion 5S in the short sides of the shadow mask.

In this case, the slits $\mathbf{14}_1$ to $\mathbf{14}_{12}$ and the embossments $\mathbf{16}_1$ to $\mathbf{16}_{12}$ of the skirt portion 5S are formed at the same time the shadow mask 5 is press-formed from a thin-sheet metal blank to provide the skirt portion 5S.

By virtue of this arrangement of the shadow mask 5 in the present embodiment, since the slits $\mathbf{14}_1$ to $\mathbf{14}_{12}$ and the embossments $\mathbf{16}_1$ to $\mathbf{16}_{12}$ are formed in the skirt portion 5S when the shadow mask 5 is press-formed from a thin-sheet metal blank to provide the skirt portion 5S, the curl S of the shadow mask 5 can be limited within a predetermined value smaller than that in the conventional shadow mask along the entire periphery of the skirt portion 5S. Since the curl S of the skirt portion 5S of the shadow mask 5 of the present invention is small, in the operation of affixing the skirt portion 5S to the inside of the support frame 6, fitting of the skirt portion 5S into the support frame 6 and welding of the fitted skirt portion 5S and the support frame 6 are facilitated, and this improves workability in affixing the skirt portion 5S to the support frame 6.

When a shadow mask 5 with excessively large curls is forcibly fitted within a support frame 6, the skirt portion 5S of the shadow mask 5 is deflected to such an excessive extent toward the interior of the shadow mask that the curved portion 5U of the shadow mask is locally depressed, and landing error of an electron beam increases and latitude of color purity decreases, resulting in degradation of color display quality.

It is preferable to reduce the maximum curl of more than 4 mm in conventional shadow masks to less than the maximum of about 2.5 mm. If the slit depth SLD (FIG. 2D) is too large, e.g., larger than 70% of the height SK of the skirt portion, distortions like creases may occur in the useful apertured portion 5U when the shadow mask is fitted within the support frame. Embossments 16 and 17 of an inappropriate height, width or depth increase rigidity of the skirt portion 5S to such an excessive extent as to distort the useful apertured portion 5U.

Figure 5:
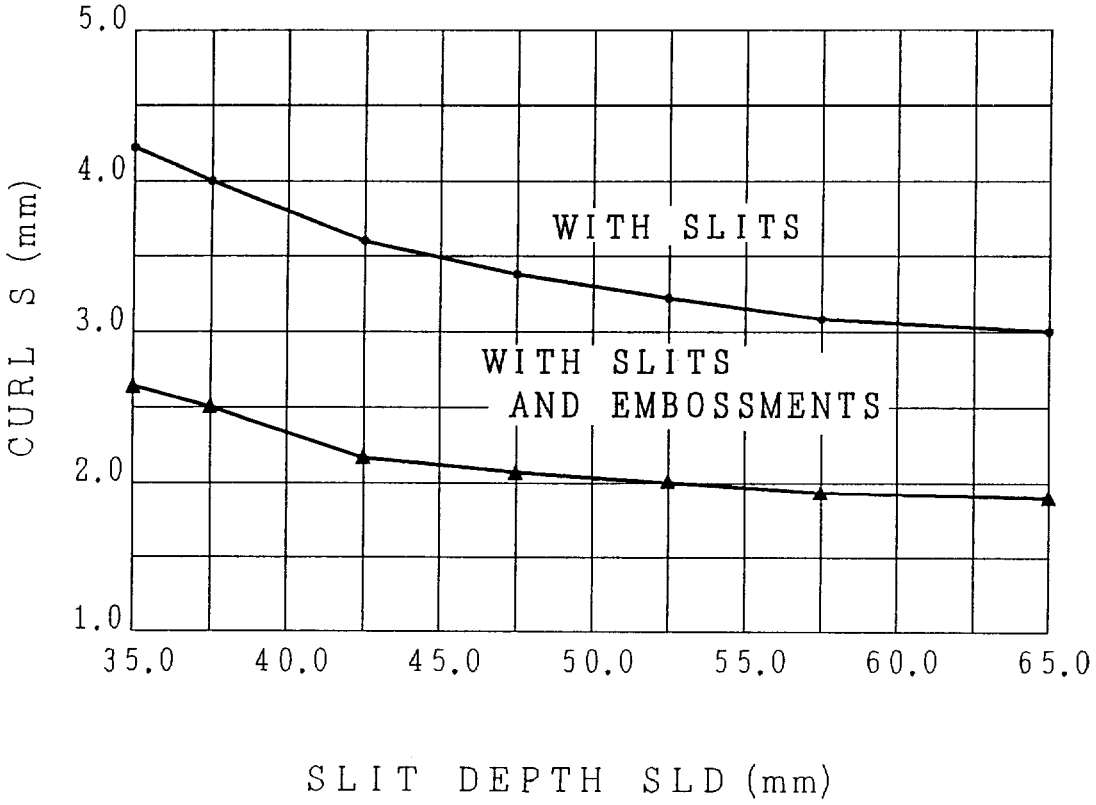
FIG. 5 is a graph showing a relationship between the amount of curls and the slit depth skirt portion height % in shadow masks with slits only and shadow masks with slits and embossments, for explaining the present invention.

FIG. 5 shows a relationship between the amount S of curls and the slit depth SLD skirt height SK % in shadow masks with slits only and shadow masks with slits and embossments, wherein the skirt height SK is 17 mm. The remainder of dimensions of the shadow masks are the same as in the above embodiment. The slit depth SLD larger than 38% of the skirt height SK limits the maximum curl to smaller than 2.5 mm in the shadow masks having the slits and embossments. It is understood from FIG. 5 that a combination of slits and embossments considerably suppresses the amount of curls as compared with shadow masks provided with slits only.

Since the skirt portion 5S of the shadow mask 5 according to the present embodiment can be easily affixed to the support frame 6, the stress caused to the skirt portion 5S fitted in the support frame is so small that the stress is not transmitted to the apertured portion 5U through the imperforate portion 5N. Therefore, the curved contour of the apertured portion 5U is not distorted, and the strength of the shadow mask 5 is not reduced.

Figure 3C:
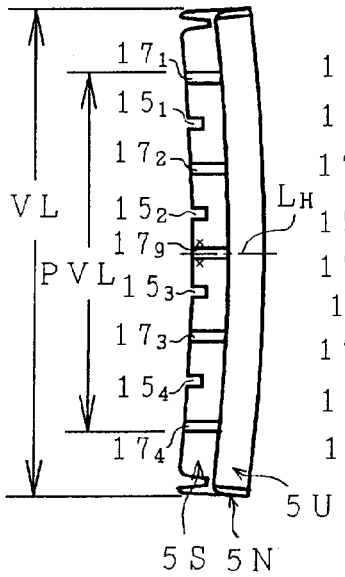
FIGS. 3A to 3C are respectively structural views showing a second embodiment of a shadow mask used for the color cathode ray tube shown in FIG. 1, FIG. 3A being a top view thereof, FIG. 3B being a side view of a long side thereof, and FIG. 3C being a side view of a short side thereof.
Figure 3A:
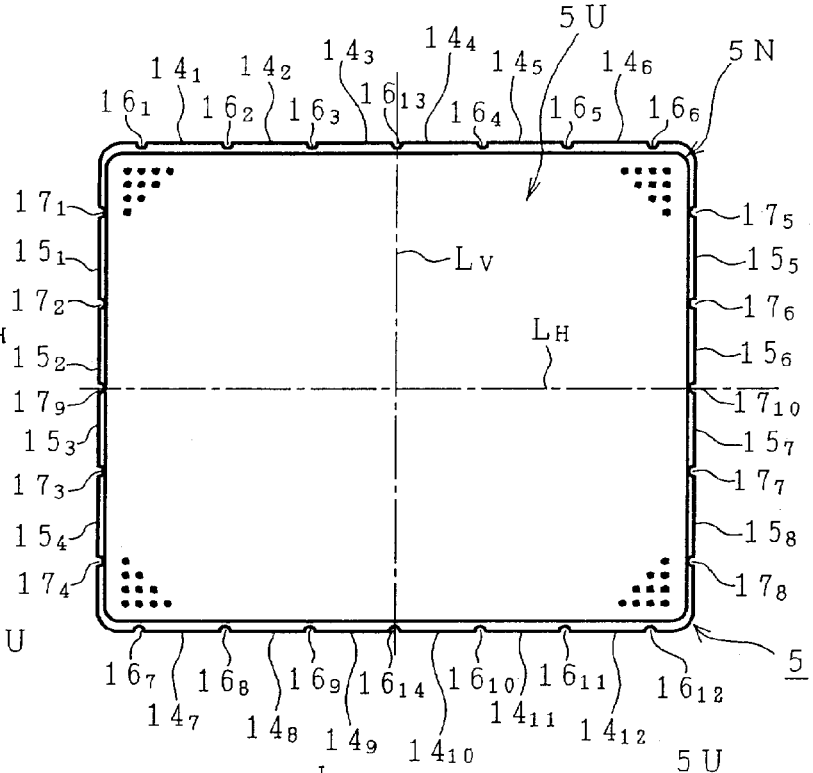
Figure 3B:
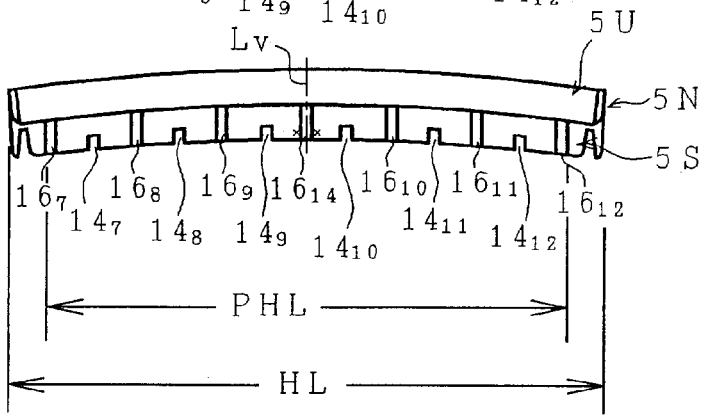
Figure 4A:
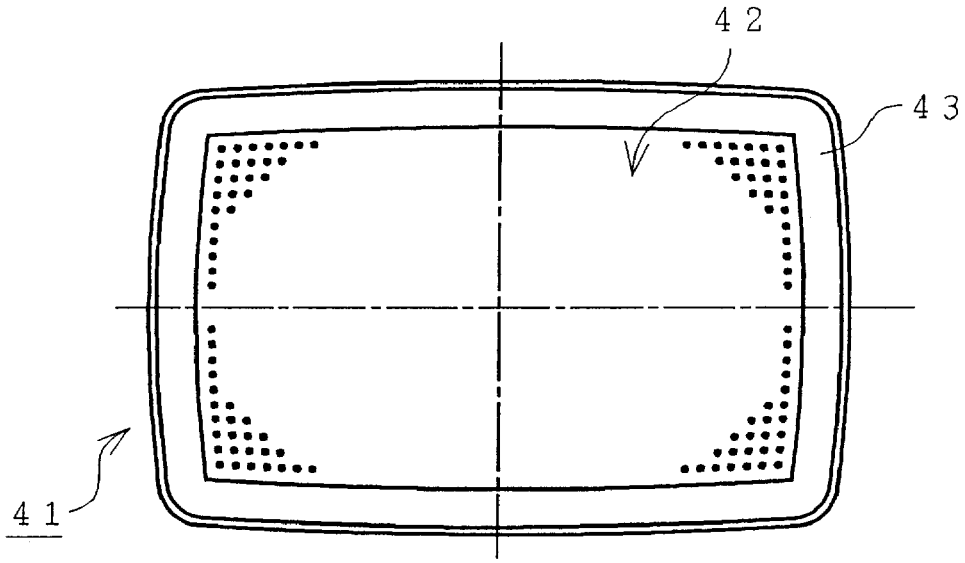
FIG. 4A (PRIOR ART)
FIGS. 4A to 4C are respectively structural views showing one example of a shadow mask used for a conventional color cathode ray tube, FIG. 4A being a top view thereof, FIG. 4B being an enlarged fragmentary side view of an area in the vicinity of welds of a skirt portion, and FIG. 4C being a sectional vies of a region extending from an imperforate portion to the skirt portion.
Figure 4B:
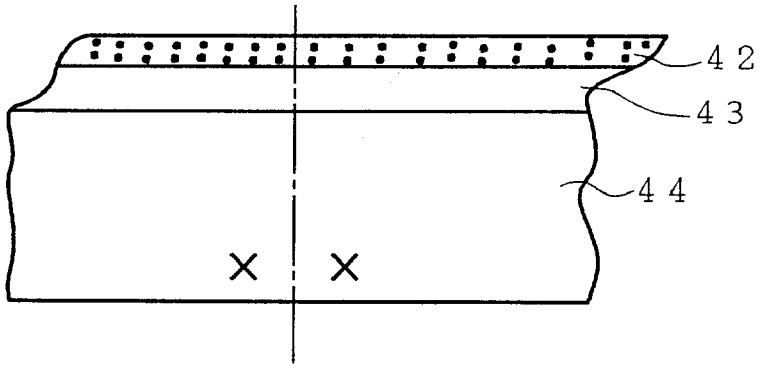
FIG. 4B (PRIOR ART)
Figure 4C:
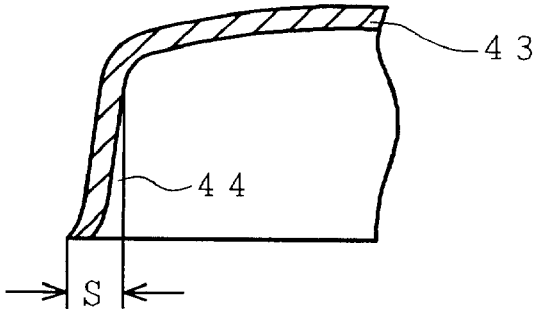
FIG. 4C (PRIOR ART)

FIGS. 3A to 3C are respectively structural views showing a second embodiment of a shadow mask used for the color cathode ray tube shown in FIG. 1, FIG. 3A being a top view thereof, FIG. 3B being a side view of a long side thereof, FIG. 3C being a side view of a short side thereof.

In FIGS. 3A to 3C, reference numerals $\mathbf{16}_{13}$ and $\mathbf{16}_{14}$ designate embossments provided on a straight line $L_V$ passing through the centers of the two long sides of the skirt portion 5S, and reference numerals $\mathbf{17}_9$ and $\mathbf{17}_{10}$ designate embossments provided on a straight line $L_H$ passing through the centers of the two short sides of the skirt portion 5S. The same constituent elements as those shown in FIGS. 2A to 2D are indicated by the same reference numerals. The enlarged view of the slits and the embossments in the present embodiment is similar to FIG. 2D.

The second embodiment is the same in construction as that of the first embodiment except that the second embodiment is provided with the embossments $\mathbf{16}_{13}$ and $\mathbf{16}_{14}$ on the line $L_V$ passing through the centers of the long sides and the embossments $\mathbf{17}_9$ and $\mathbf{17}_{10}$ on the line $L_H$ passing through the centers of the short sides, and the number of the embossments, 7 and 5, in the long side and the short side, respectively, comprising the embossments $\mathbf{16}_1$ to $\mathbf{16}_{14}$ and $\mathbf{17}_1$ to $\mathbf{17}_{10}$, is larger by one than the number of the slits, 6 and 4, in the long side and short side, respectively, comprising the slits $\mathbf{14}_1$ to $\mathbf{14}_{12}$ and $\mathbf{15}_1$ to $\mathbf{15}_8$, while the first embodiment is not provided with the embossments $\mathbf{16}_{13}$ and $\mathbf{16}_{14}$, $\mathbf{17}_9$ and $\mathbf{17}_{10}$ on the center lines, the number of the embossments, 6 and 4, in the long side and the short side, respectively, comprising the embossments $\mathbf{16}_1$ to $\mathbf{16}_{12}$ and $\mathbf{17}_1$ to $\mathbf{17}_8$, is the same as the number of the slits, 6 and 4, in the long side and the short side, respectively, comprising the slits $\mathbf{14}_1$ to $\mathbf{14}_{12}$ and $\mathbf{15}_1$ to $\mathbf{15}_8$. Therefore, the construction of the shadow mask 5 in the second embodiment will not be explained further.

Further, the operation, the function and the effects resulting from the operation of the second embodiment are generally the same as those of the first embodiment, and those of the second embodiment will not be explained further.

While in the above embodiments, the number of the slits ($\mathbf{14}_1$ to $\mathbf{14}_{12}$ and $\mathbf{15}_1$ to $\mathbf{15}_8$) and the spacing therebetween provided in the skirt portion 5S and the number of the embossments ($\mathbf{16}_1$ to $\mathbf{16}_{12}$ and $\mathbf{17}_1$ to $\mathbf{17}_8$) and the spacing therebetween have been specifically explained, the number and the spacing are merely mentioned by way of examples in the embodiments, and the number of the slits and the embossments and the spacing therebetween can be properly determined in each case. That is, the spacing between the center line $L_V$ of the long sides and the slits adjacent thereto, and the spacing between the center line $L_H$ of the short sides and the slits adjacent thereto can be respectively chosen within the range of 20 to 30 mm, and the spacing between two adjacent slits and the spacing between two adjacent embossments can be respectively chosen within the range of 40 to 60 mm.

While, in the above embodiments, the shadow masks 5 used for a color cathode ray tube having a 19-inch outside diagonal panel portion have been taken as examples, the shadow mask 5 of the present invention is not limited to application of tubes having a 19-inch outside diagonal panel portion, but can be similarly applied to cathode ray tubes having a panel portion of other outside diagonal dimension.

Figure 6C:
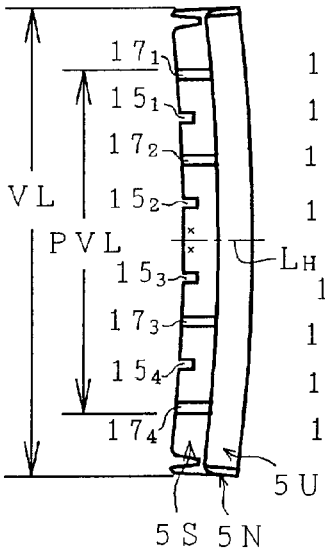
FIGS. 6A to 6D show a modification of the first embodiment, FIG. 6A being a top view thereof, FIG. 6B being a side view of a long side thereof, FIG. 6C being a side view of a short side thereof, and FIG. 6D being an enlarged fragmentary perspective view of a skirt portion thereof.
Figure 6A:
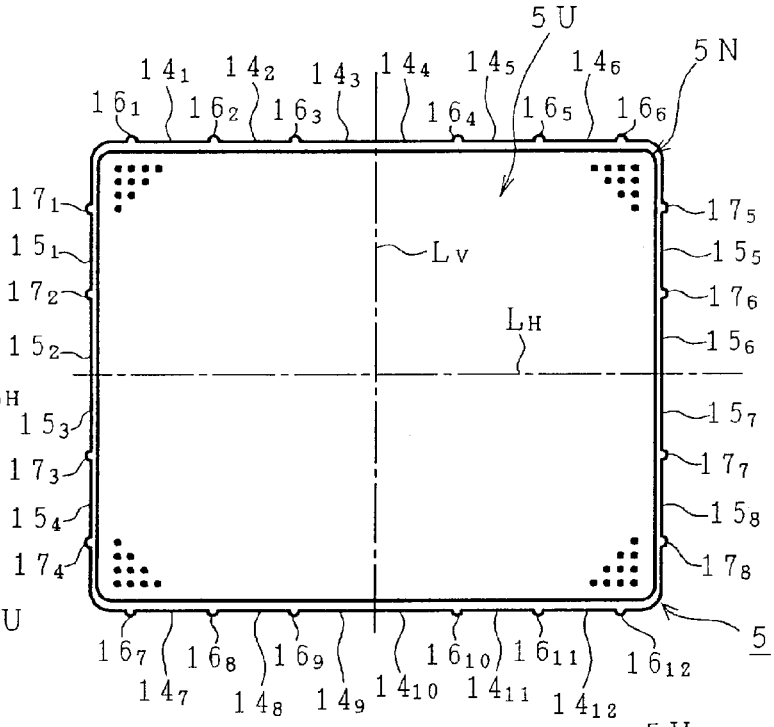
Figure 6B:
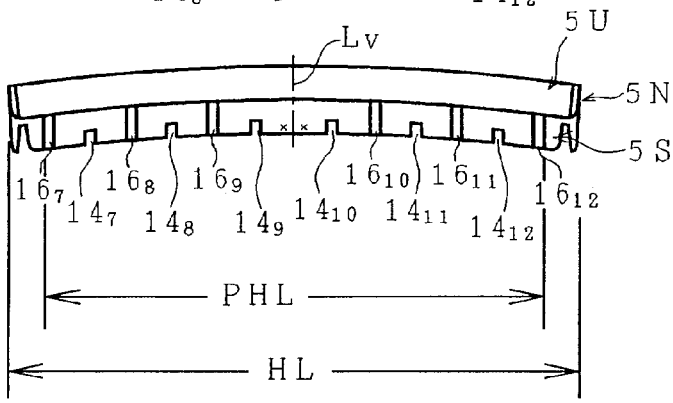
Figure 6D:
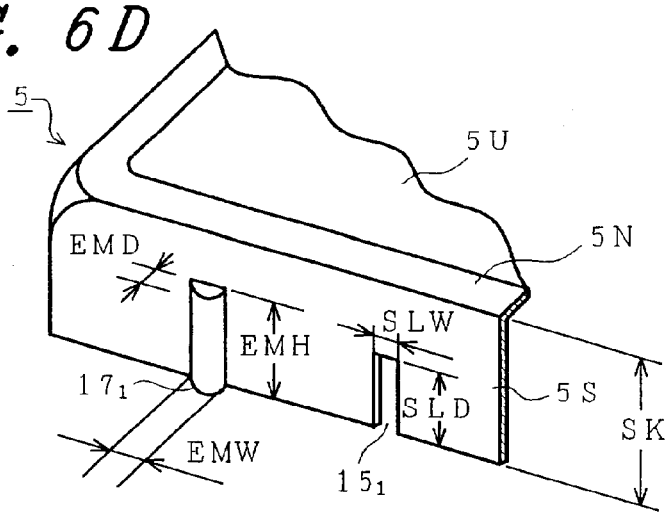
Figure 7C:
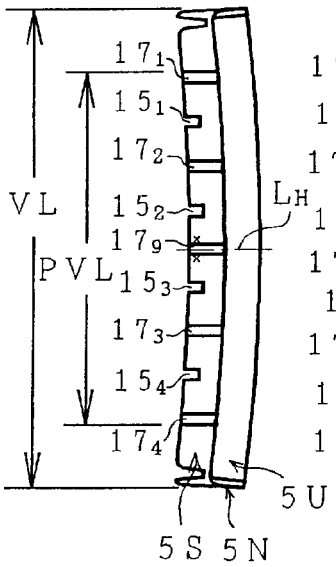
FIGS. 7A to 7C show a modification of the second embodiment, FIG. 7A being a top view thereof, FIG. 7B being a side view of a long side thereof, and FIG. 7C being a side view of a short side thereof.
Figure 7A:
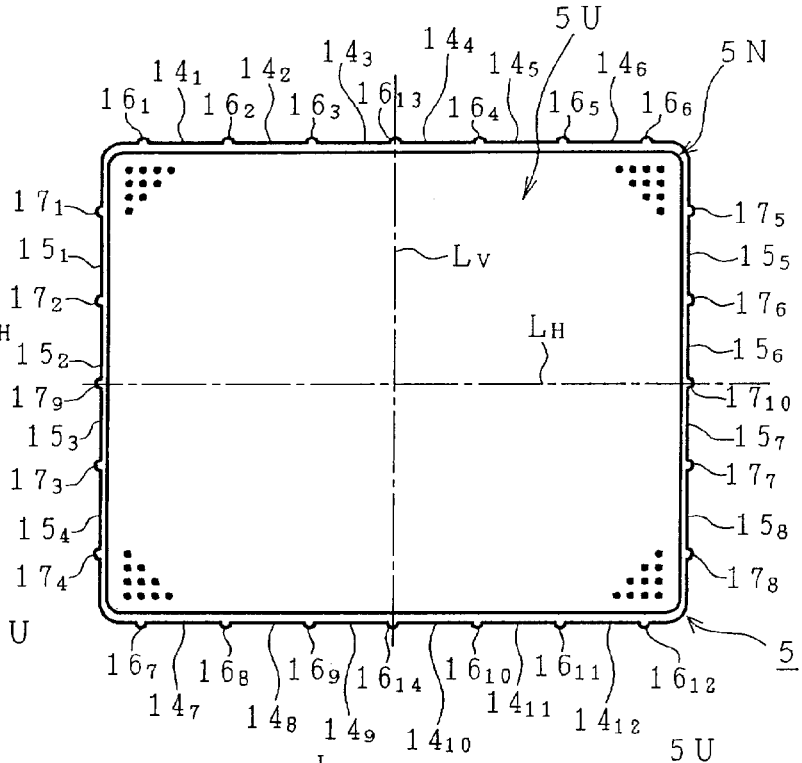
Figure 7B:
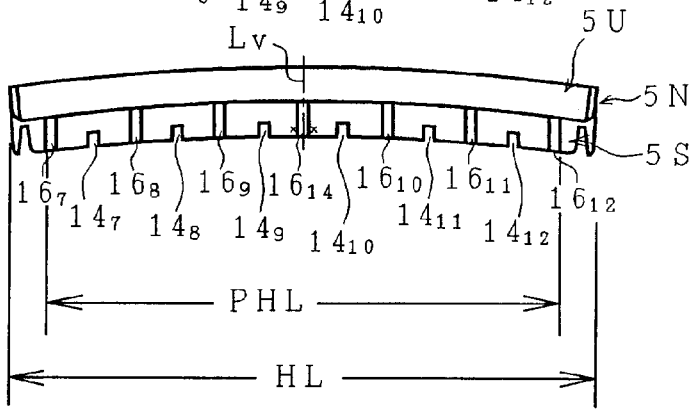
Figure 8:
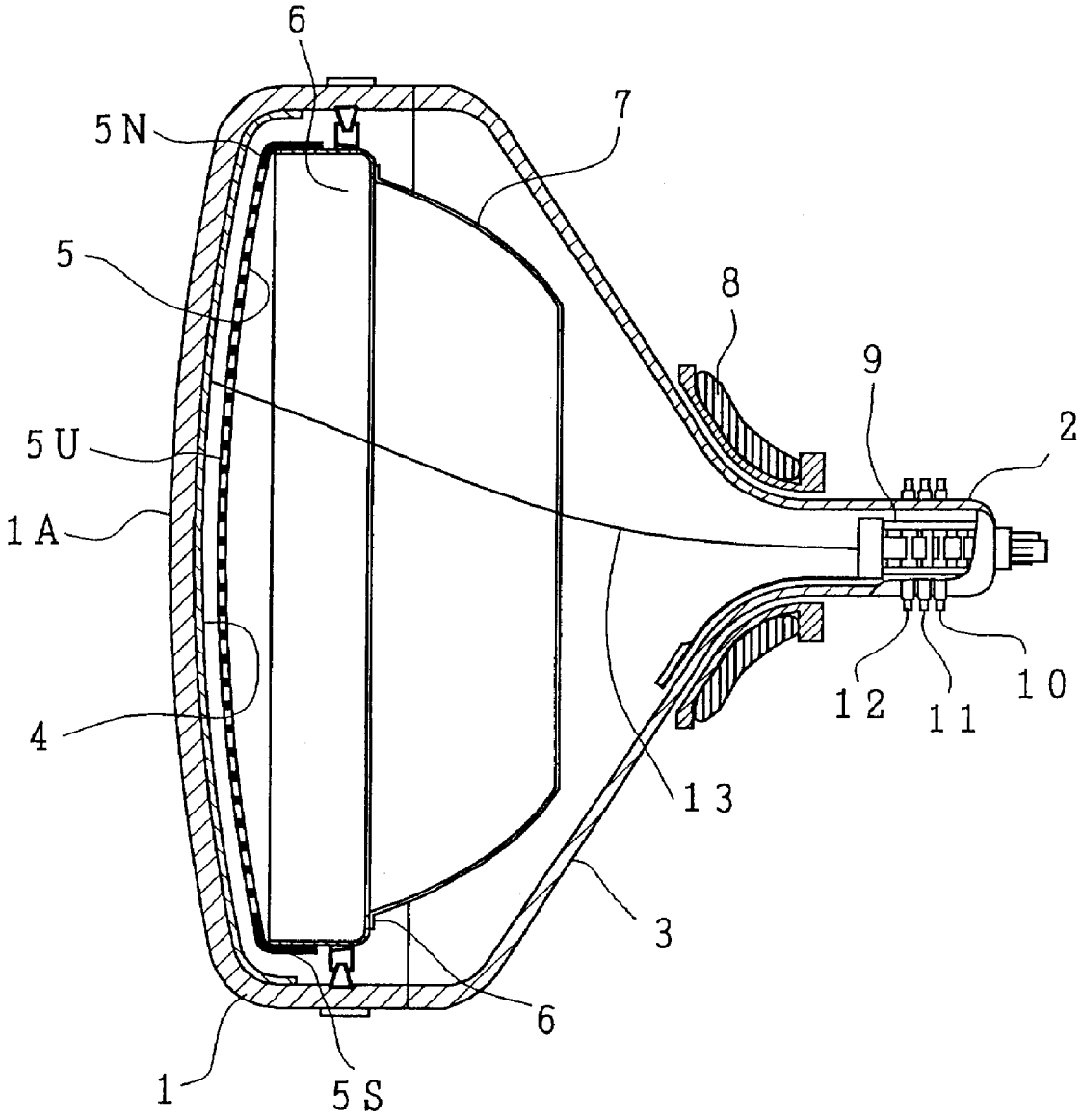
FIG. 8 is a sectional view of a color cathode ray tube according to the present invention employing a shadow mask according to the modification shown in FIGS. 6A to 6D or the modification shown in FIGS. 7A to 7C.

While, in the above embodiments, the embossments protrude inwardly, the present invention is not limited thereto, but they can protrude outwardly to provide the similar function and effects. An embodiment corresponding to the first embodiment and another embodiment corresponding to the second embodiment are shown in FIGS. 6A to 6D and FIGS. 7A to 7C, respectively. The details of the embossments and slits are shown in FIG. 6D. These modification of the shadow mask 5 is fitted outside the support frame 6 as shown in FIG. 8.

Figure 9A:
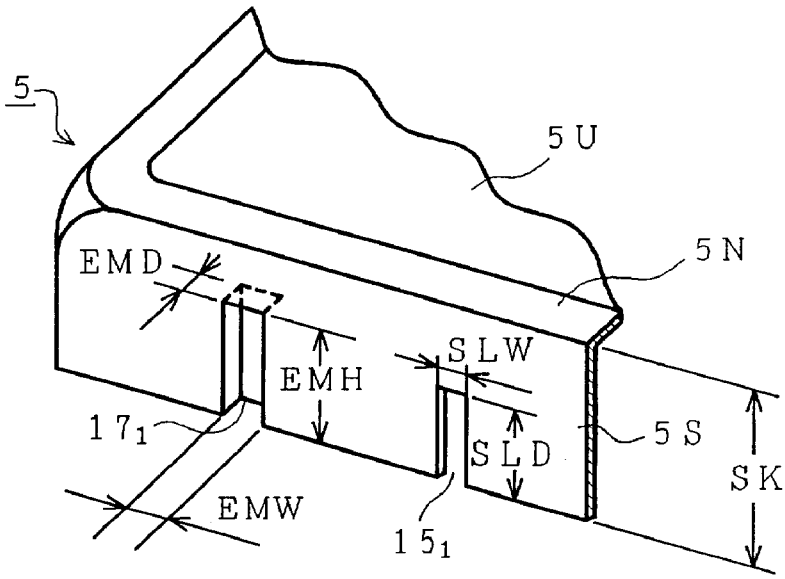
FIGS. 9A and 9B are respectively enlarged fragmentary perspective views of a skirt portion showing two other embodiments of the embossments in the skirt portion of the shadow mask according to the present invention.
Figure 9B:
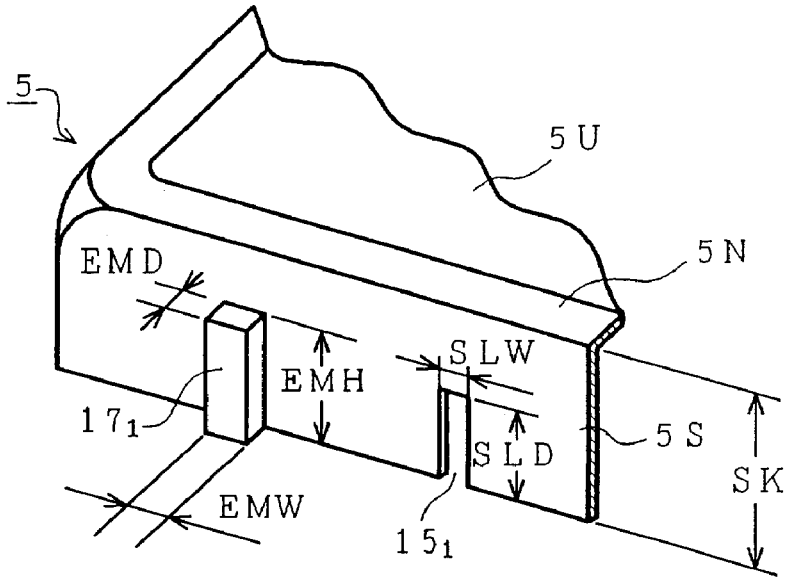

While, in the above embodiments, the embossments are arcuate in cross section, the present invention is not limited thereto, but they can be rectangular in cross section and protrude inwardly or outwardly as shown in FIGS. 9A and 9B, respectively, to provide the similar function and effects.

The results from various experiments similar to the above embodiments are summarized as follows:

(1) It is preferable to distribute slits and embossments over each of central portions extending a distance PHL and PVL in length of long and extending a distance short sides of the skirt portion, respectively (see FIGS. 2B, 2C, 3B, 3C, 6B, 6C, 7B and 7C, wherein PHL and PVL satisfy the following inequalities:

$$0.5\ HL \leqq PHL \leqq 0.85\ HL$$

$$0.5\ VL \leqq PVL \leqq 0.85\ VL$$

where HL and VL are longitudinal lengths of the long and short sides of the skirt portion, respectively (see FIGS. 2B, 2C, 3B, 3C, 6B, 6C,7B, and 7C).

(2) It is preferable that slits and embossments are 2 to 10 and 2 to 15 in number, respectively, in each of the above-mentioned central portions (PHL, PVL) (see FIGS. 2A, 2B, 2C, 3A, 3B, 3C, 6A, 6B, 6C, 7A, 7B, and 7C).

(3) It is preferable that slits extend a distance SLD of 30 to 70% of the height SK of the skirt portion from a rear end thereof as shown in FIG. 5. (see FIGS. 2D, 6D, 9A and 9B).

(4) It is preferable that a width SLW of slits is 25 to 50% of a longitudinal length SLD thereof (see FIGS. 2D, 6D, 9A and 9B).

(5) It is preferable that embossments extend a distance EMH of 80 to 100% of the height SK of the skirt portion (see FIGS. 2D, 6D, 9A and 9B).

(6) It is preferable that a cross section of embossments is 2 to 15 mm (EMW) measured along a side of the skirt portion having the embossments and 0.2 to 1.0 mm (EMD) measured perpendicular to the side of the skirt portion (see FIGS. 2D, 6D, 9A and 9B).

(7) It is preferable that, when a pair of slits are disposed at a central portion of 2 to 20% of the longitudinal length (HL, VL) of each of long and short sides of the skirt portion, the remainder of the slits are spaced a distance of 10 to 70 mm from each other (see FIGS. 2A to 2C, 3A to 3C, 6A to 6C, and 7A to 7C).

(8) It is preferable that, when a pair of embossments are disposed at a central portion of 5 to 50% of the longitudinal length (HL, VL) of each of long and short sides of the skirt portion, the remainder of the embossments are spaced a distance of 5 to 70 mm from each other (see FIGS. 2A to 2C, 3A to 3C, 6A to 6C, and 7A to 7C).

(9) It is preferable that, when one embossment is disposed at a midpoint of each of long and short sides of the skirt portion, the remainder of the embossments are spaced a distance of 10 to 70 mm from each other (see FIGS. 3A to 3C and 7A to 7C).

(10) It is preferable that, when a pair of embossments are disposed at a central portion of 3 to 20% of the longitudinal length (HL, VL) of each of long and short sides of the skirt portion, embossments are spaced a distance of 5 to 35 mm from adjacent ones of slits in a portion excluding the central portion of 3 to 20% of the longitudinal length (see FIGS. 2A to 2C, 3A to 3C, 6A to 6C, and 7A to 7C).

(11) It is preferable that embossments are spaced a distance of 5 to 35 mm from adjacent ones of slits (see FIGS. 2A to 2C, 3A to 3C, 6A to 6C, and 7A to 7C).

(12) It is preferable that zero to four of embossments are disposed between two adjacent ones of slits (see FIGS. 2A to 2C, 3A to 3C, 6A to 6C, and 7A to 7C).

As described above, according to the present invention, a plurality of slits and a plurality of embossments are formed to be juxtaposed over a wide region of each of long and short sides of the skirt portion in the same operation used for press-forming the skirt portion. This reduces significantly the tendency of the press-formed skirt portion to return to its initial form, reduces the curl S produced in the skirt portion, and limits the curl S within a relatively small range over the entire periphery of the skirt portion.

Further, according to the present invention, the stress caused to the skirt portion by fitting the skirt portion in the support frame is not transmitted to the imperforate portion or the apertured portion so that the curved contour of the apertured portion of the shadow mask is not distorted, and consequently the color selection property of the shadow mask is not deteriorated, or the strength of the shadow mask is not reduced.

What is claimed is:

1. A color cathode tube including a generally rectangular shadow mask having a curved apertured portion having a multiplicity of electron-transmissive apertures, a curved imperforate portion surrounding and integral with said apertured portion and a skirt portion bent back from a periphery of said curved imperforate portion, and a generally rectangular support frame for suspending said shadow mask by spot welding said skirt portion thereto, within a panel portion of said color cathode ray tube;

said skirt portion being provided with a plurality of slits extending in a direction of a height of said skirt portion and a plurality of embossments extending in said direction of the height of said skirt portion in at least one of a long side and a short side of said skirt portion;

said plurality of slits and said plurality of embossments being juxtaposed around a circumference of said skirt portion, a majority of said plurality of slits in said at least one of said long side and said short side of said skirt portion being unbridled slits.

2. A cathode ray tube according to claim 1, wherein said plurality of slits extend a distance of 50% or less of the height of said skirt portion from a rear end of said skirt portion on an opposite side thereof from said panel portion and said plurality of embossments extend an entire length of the height of said skirt portion.

3. A cathode ray tube according to claim 1, wherein a pair of said plurality of slits are disposed one on each side of a midpoint of each of long and short sides of said skirt portion, and remainders of said plurality of slits and said plurality of embossments are arranged alternately with each other.

4. A cathode ray tube according to claim 1, wherein a pair of said plurality of embossments are disposed one on each side of a midpoint of each of long and short sides of said skirt portion, and remainders of said plurality of slits and said plurality of embossments are arranged alternately with each other.

5. A color cathode ray tube according to claim 1, wherein said plurality of slits extend a fixed length from a rear end of said skirt portion on an opposite side thereof from said panel portion.

6. A color cathode ray tube according to claim 1, wherein said plurality of embossments protrude inwardly.

7. A color cathode ray tube according to claim 1, wherein said plurality of embossments are arcuate in cross section.

8. A cathode ray tube according to claim 1, wherein each of said plurality of slits is an unbridged slot.

9. A cathode ray tube according to claim 1, wherein at least two of said plurality of slits are alternately arranged with at least two of said plurality of embossments in at least one of the long and short sides of said skirt portion.

* * * * *

UNITED STATES PATENT AND TRADEMARK OFFICE

CERTIFICATE OF CORRECTION

PATENT NO. : 6,111,346

DATED : August 29, 2000

INVENTOR(S) : Ito, et al.

It is certified that error appears in the above-identified patent and that said Letters Patent is hereby corrected as shown below:

Col. 10, line 32 (Claim 1, last line)
replace "unbridled"
with --unbridged--.

Col. 10, line 58 (Claim 8, line 2)
replace "slot"
with --slit--.

Signed and Sealed this

Eighth Day of May, 2001

*Attest:*

Nicholas P. Godici

NICHOLAS P. GODICI

*Attesting Officer*

*Acting Director of the United States Patent and Trademark Office*